US010443286B1

(12) United States Patent
Cocco

(10) Patent No.: US 10,443,286 B1
(45) Date of Patent: Oct. 15, 2019

(54) APPARATUS FOR SUPPORTING A DOOR OF AN APPLIANCE

(71) Applicant: Andria K. Cocco, W. Palm Beach, FL (US)

(72) Inventor: Andria K. Cocco, W. Palm Beach, FL (US)

( * ) Notice: Subject to any disclaimer, the term of this patent is extended or adjusted under 35 U.S.C. 154(b) by 0 days.

(21) Appl. No.: 16/023,915

(22) Filed: Jun. 29, 2018

(51) Int. Cl.
*E05F 7/06* (2006.01)
*A47L 15/42* (2006.01)
*F25D 23/02* (2006.01)

(52) U.S. Cl.
CPC ..... *E05F 7/06* (2013.01); *A47L 15/4257* (2013.01); *E05Y 2900/30* (2013.01); *F25D 23/028* (2013.01); *Y10T 16/61* (2015.01)

(58) Field of Classification Search
CPC ..... E05F 7/06; E05F 5/06; A47L 15/4257; E05Y 2900/30; F25D 23/028; E05C 17/54; E05C 17/047; E05C 17/30; E05C 19/004; Y10T 16/61
USPC ..... 16/82; 292/338, 339, 343; 312/405; 134/57 D, 58 D, 58 DL
See application file for complete search history.

(56) References Cited

U.S. PATENT DOCUMENTS 2,709,615 A * 5/1955 Barnes, Jr. ..... E05C 17/443 16/85
3,731,341 A * 5/1973 Woodruff ..... E05C 19/004 16/82
3,912,350 A * 10/1975 Gurubatham ..... A47L 15/4261 126/191
4,421,348 A * 12/1983 Kahn ..... E05C 19/004 292/339
5,135,273 A * 8/1992 MacCalder ..... E05C 19/004 292/338
5,383,724 A 1/1995 Wrangberth et al.
5,542,725 A * 8/1996 Ballew ..... B25B 5/068 292/288
6,120,072 A * 9/2000 Benedict ..... E05C 17/443 292/338
6,484,445 B2 * 11/2002 Chang ..... E05B 65/0823 292/289
7,937,806 B1 * 5/2011 Doyle ..... E05F 5/02 16/82
7,938,461 B2 * 5/2011 Ollinger ..... E05C 17/44 16/82
9,702,174 B2 * 7/2017 Hatton ..... E05C 17/443
2004/0163684 A1 8/2004 Hapke
2009/0255085 A1 * 10/2009 Lorenzati ..... E05F 5/04 16/82
2010/0319160 A1 * 12/2010 Rooney ..... E05C 17/443 16/82

(Continued)

*Primary Examiner* — William L Miller
(74) *Attorney, Agent, or Firm* — Sanchelima & Associates, P.A.; Christian Sanchelima; Jesus Sanchelima

(57) ABSTRACT

An apparatus for supporting a door of an appliance is disclosed. The apparatus is secured to the door. The apparatus comprises an elongated structure extending over a length of the door. The elongated structure comprises a support arm at one end. The support arm is used to couple the elongated structure to the door of the appliance. The apparatus comprises a hinge provided at the elongated structure. The hinge facilitates in rotation of the elongated structure to support the door when the door is in open position. The appliance includes a dishwasher or a refrigerator.

6 Claims, 5 Drawing Sheets

(56) References Cited

U.S. PATENT DOCUMENTS

2011/0278866 A1* 11/2011 Lee ..... E05C 17/54
292/339
2014/0375070 A1* 12/2014 Hatton ..... E05C 17/443
292/339

* cited by examiner

APPARATUS FOR SUPPORTING A DOOR OF AN APPLIANCE

BACKGROUND OF THE INVENTION

1. Field of the Invention

The present disclosure generally relates to support members provided for doors. More specifically, the present disclosure generally relates to an apparatus for supporting a door of an appliance in an open position.

2. Description of the Related Art

It is known that several appliances are used in households for doing various tasks. The appliances may include, but not limited to a dishwasher, a refrigerator and so on. The dishwasher is a mechanical device used for cleaning dishware and cutlery. Typically, the dishwasher comprises a box-like structure comprising a plurality of racks used to place the dishware. In order to clean the dishware, pressurized jets of hot water is made to shoot all around the dishware. Generally, the dishwasher is closed during the operation of the cleaning. After completion of the cleaning, the dishware is removed from the dishwasher.

Typically, the dishwasher is provided with a door at bottom that is used to access inner portion of the dishwasher. The door is pivotally attached to the dishwasher for providing accessibility to the dishwashing space for loading and unloading dishes or other washable items. In other words, the door extends approximately from the upper edge of the dishwasher to the lower quarter of the dishwasher height.

Several attempts have been made in the past to provide a door for the dishwasher. For example, United States patent application US20040163684 discloses a dishwasher door having an electric actuator that moves the door from a close position adjacent to the opening of the washing chamber to a seal position. Another example is disclosed in a United States granted patent 5383724. In U.S. Pat. No. 5,383,724, an assembly for mounting an outer or external panel to a door for a mid-sized built in dishwasher is disclosed.

It should be noted that the above disclosures have several problems. For instance, when the door is in open position, indicating that the user can access the dishware placed in the dishwasher, the door is supported by the hinge used to couple the door to the dishwasher. If the dishwasher is placed on a counter-top or at certain height from ground, then the door will hang towards the ground with support only from the hinge. This may cause the hinge to break over a period of time. Further, when the dishwasher is placed on ground or underside of a counter-top or a kitchen sink, the door opens and comes in horizontal plane with the ground. When the door is in open position, a user may accidently step on the door putting pressure on the hinge. As a result, the hinge may break and make the dishwasher unusable until the hinge is fixed or may even damage the door. None of the above disclosures disclose a solution to support the door when it is in open position.

Other documents describing the closest subject matter provide for a number of more or less complicated features that fail to solve the problem in an efficient and economical way. None of these patents suggest the novel features of the present invention. Specifically, none of the disclosures in the art disclose an apparatus used to secure a door of an appliance when the door is in open position.

Therefore, there is a need in the art for an apparatus to support a door of an appliance when the door is in open position.

SUMMARY OF THE INVENTION

It is one of the main objects of the present invention to provide an apparatus to support a door of an appliance when the door is in open position that avoids the drawbacks of the prior art.

It is one object of the present invention is to provide an apparatus coupled to a door of an appliance such as a dishwasher or a refrigerator.

It is one object of the present invention is to provide an apparatus for supporting a door of an appliance. The apparatus comprises an elongated structure having a support arm. The support arm is used to couple the elongated structure to the door of the appliance. The apparatus comprises a hinge provided at the elongated structure. The hinge facilitates in rotation of the elongated structure to support the door when the door is in open position.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

The following detailed description is intended to provide example implementations to one of ordinary skill in the art, and is not intended to limit the invention to the explicit disclosure, as one or ordinary skill in the art will understand that variations can be substituted that are within the scope of the invention as described.

The present disclosure discloses an apparatus for supporting a door of an appliance. The apparatus is secured to the door at the top. The appliance may include, but not limited to, a dishwasher or a refrigerator. The apparatus comprises an elongated structure extending over a length of the door. The elongated structure comprises a support arm at one end. The support arm is used to couple the elongated structure to the door of the appliance. The apparatus comprises a hinge provided at the elongated structure. The hinge facilitates in rotation of the elongated structure to support the door when the door is in open position.

Various features and embodiments of an apparatus for supporting a door of an appliance are explained in conjunction with the description of FIGS. 1-3B.

Figure 1:
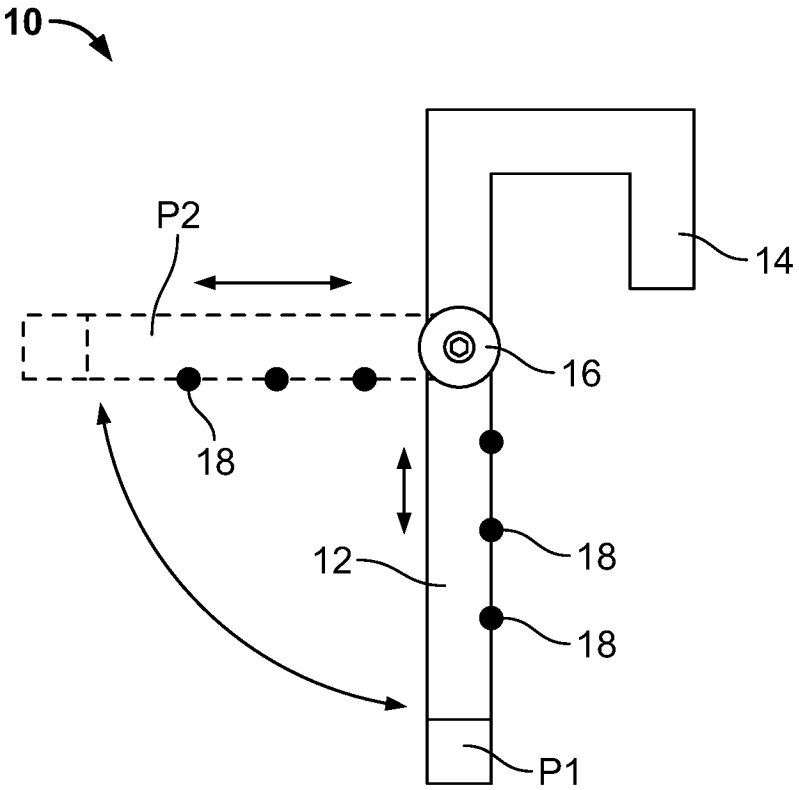
FIG. 1 illustrates a side view an apparatus 10, in accordance with one embodiment of the present disclosure.

Referring to FIG. 1, a side view of an apparatus 10, in accordance with one embodiment of the present disclosure. The apparatus 10 comprises an elongated structure 12. The elongated structure 12 comprises a support arm 14. The support arm 24 is provided in a hook-like structure and can be used to couple the elongated structure 12 to an appliance (not shown). The elongated structure 12 comprises a hinge 16 provided at substantially mid portion of the elongated structure 12 such that the elongated structure 12 is made to swing at about 90 degrees.

In one exemplary embodiment, the elongated structure 12 is provided with a plurality of telescopic buttons 18 at its surface. In the present embodiment, the elongated structure 12 may portions with different diameter progressively decreasing at its length. Each of the plurality of telescopic buttons 18 may be provided at the position where the elongated structure 12 has different diameter. The telescopic buttons 18 may be operated such that the portion where the diameter of the elongated structure 12 is more receives the portion having smaller diameter. In order words, when the elongated structure 12 is fully contracted, length of the elongated structure 12 will be same as the length of the portion that has larger diameter. Similarly, when the elongated structure 12 is fully expanded, length of the elongated structure 12 will be same as the combined length of all the portions having different diameters. As such, the length of the elongated structure 12 can be adjusted. In one example, the telescopic buttons 18 may be provided in a push button configuration such that when pressed allows the portion where the diameter of the elongated structure 12 is more is made to receive beside portion having smaller diameter.

In use, the elongated structure 12 is kept at a first position P1. Further, the elongated structure 12 may be swung at about 90 degrees to move to a second position P2 as shown in FIG. 1. As explained above, the length of the elongated structure 12 may be adjusted using the telescopic buttons 18 in the first position P1 or in the second position P2.

Figure 2A:
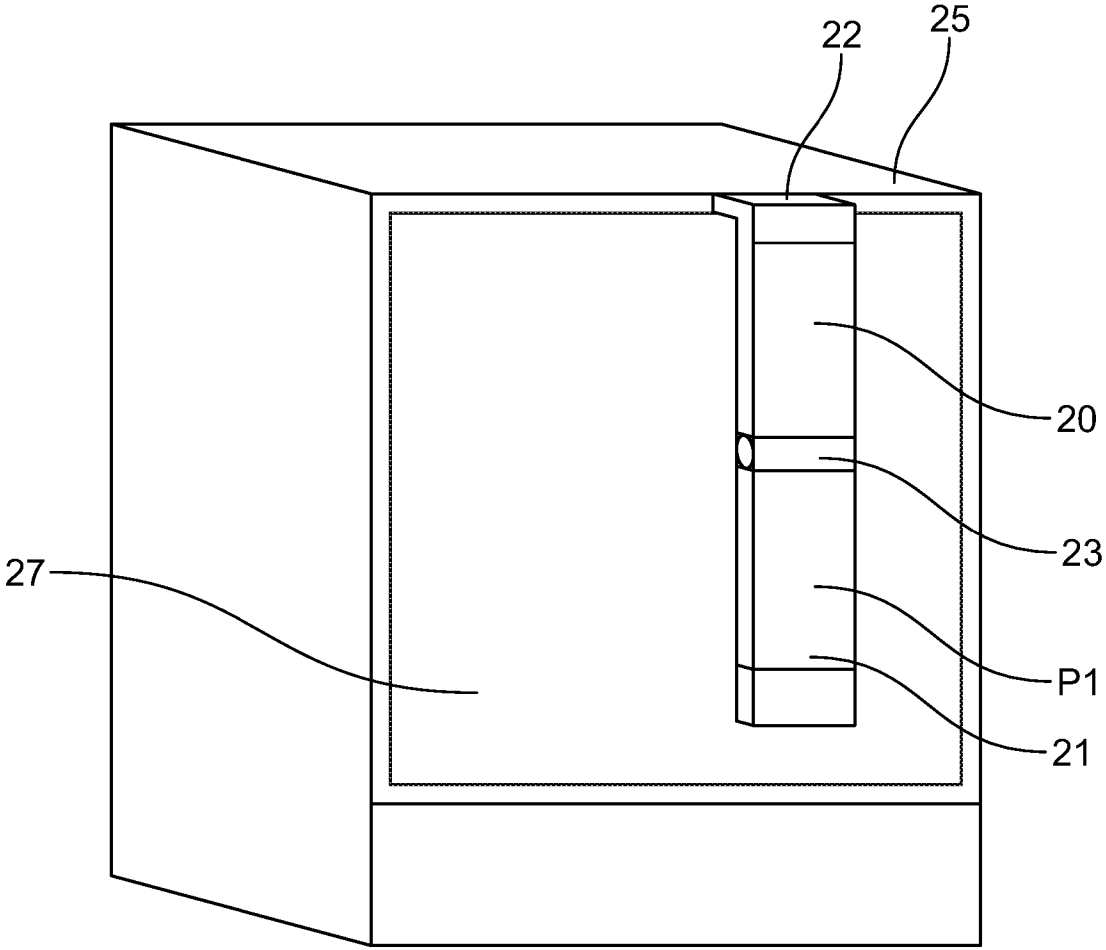
FIGS. 2A and 2B illustrate a perspective view of an apparatus 20 coupled to a door 27 of an appliance 25 in a first position P1 and a second position P2, respectively, in accordance with one embodiment of the present disclosure.
Figure 2B:
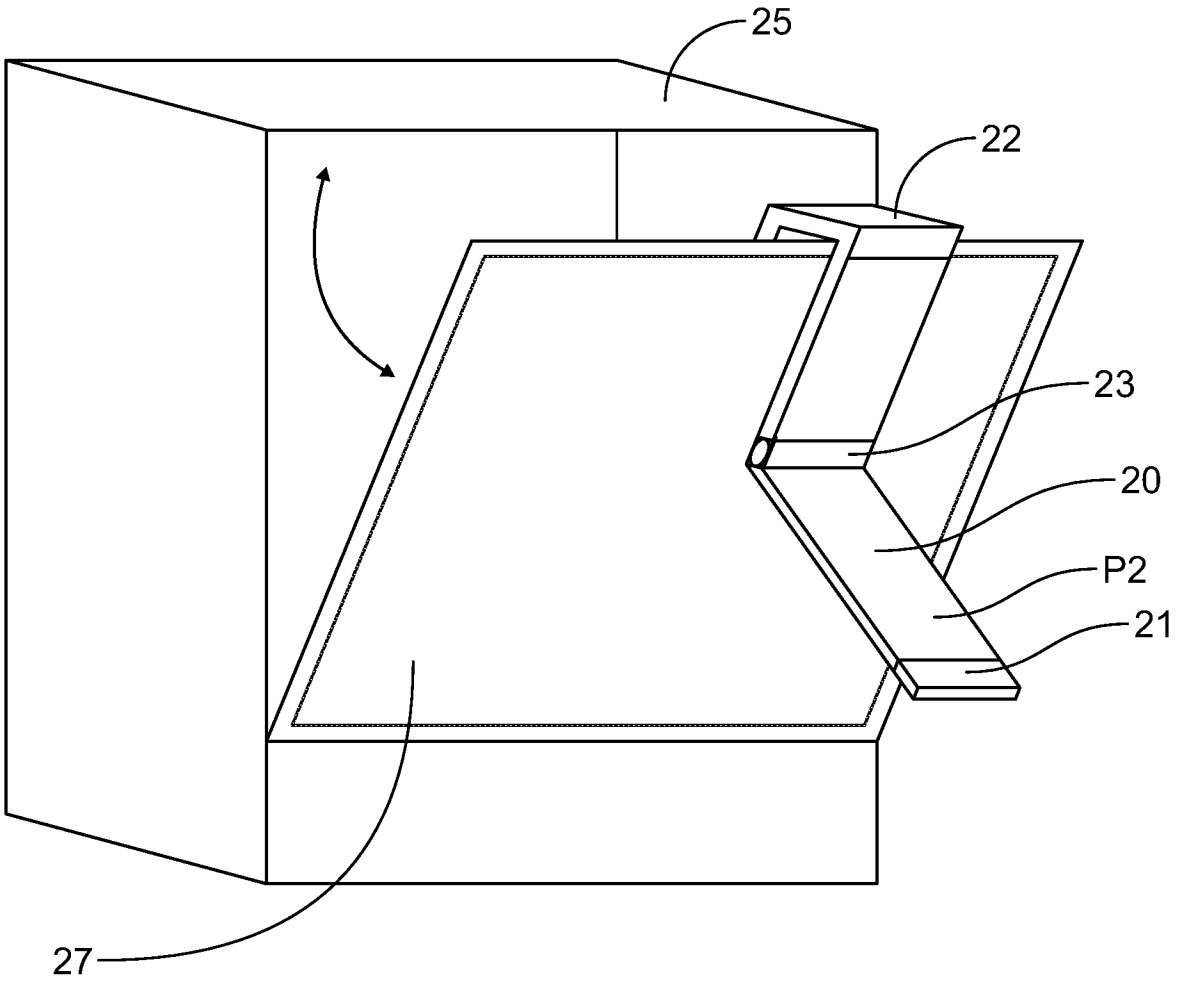

Referring to FIGS. 2A and 2B, an apparatus 20 coupled to an appliance 25 is shown, in accordance with one exemplary embodiment of the present disclosure. The appliance 25 may include any household appliance such as a dishwasher, micro oven, refrigerator and so on. The present example is explained considering that the appliance 25 is a dishwasher. Specifically, the appliance 25 comprises a door 27 that opens downwards. The door 27 may be coupled to the appliance 25 for providing accessibility to the dishwashing space for loading and unloading dishes or other washable items.

In order to support the door 27 when opened, the apparatus 20 is coupled to the door 27 at top. As explained above, the apparatus 20 comprises an elongated structure 21. The elongated structure 21 extends over a length of the door 27. The elongated structure 21 comprises a support arm 22 provided in a hook-like structure. The size of the support arm 22 is chosen in such a way that the door 27 is closed and opened without altering function of the door 27. The elongated structure 21 further comprises a hinge 23 to swing the elongated structure 21. In order to couple the apparatus 20 to the door 27, at first, the support arm 22 is placed on top of the door 27. Referring to FIG. 2A, the elongated structure 21 coupled to the door 27 is shown. Specifically, the elongated structure 21 is coupled in a first position P1 when the door 27 is closed. It should be understood that the apparatus 20 is chosen in such a way that weight of the apparatus 20 does not alter position or function of the door 27.

When the door 27 is opened partially or fully, the apparatus 20 is used to provide support for the door 27. Specifically, the elongated structure 21 is stretched/opened/swung such that the elongated structure 21 is made to come to a second position P2 as shown in FIG. 2B. It should be understood that open end of the elongated structure 21 is rested on the ground such that the apparatus 20 takes the weight of the door 27. As a result, pressure on a pivot (not shown) of the appliance 25 used to couple the door 27 is avoided/minimized. In addition, additional weight or pressure exerted on the door 27 either by user or a dishware (not shown) placed inside the appliance 25 is transferred to the apparatus 20 i.e., to the elongated stricture 21.

Length of the elongated structure 21 may be adjusted by providing telescopic buttons (not shown) on its surface. The length of the elongated structure 21 may be adjusted based on partial or full opening of the door 27.

Figure 3A:
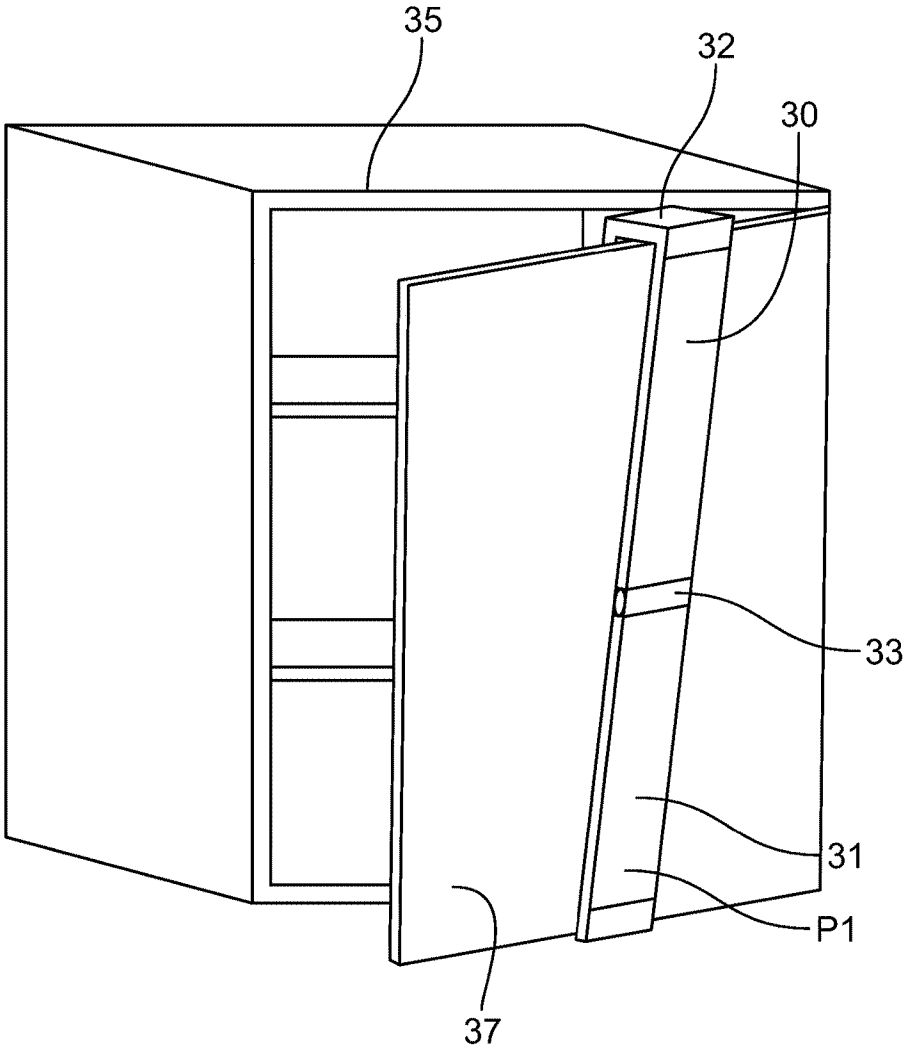
FIGS. 3A and 3B illustrate a perspective view of an apparatus 30 coupled to a door 37 of an appliance 35 in a first position P1 and a second position P2, respectively, in accordance with one embodiment of the present disclosure.
Figure 3B:
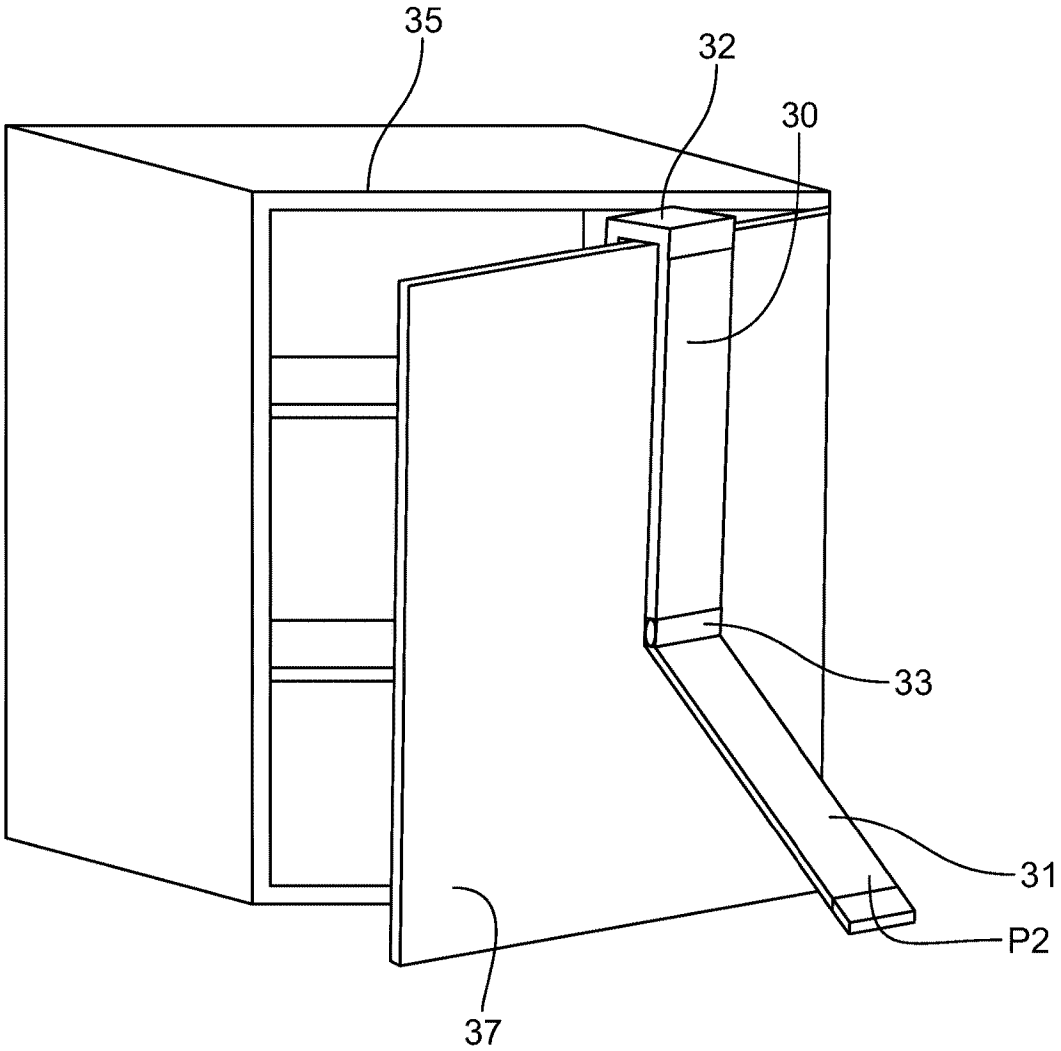

Now referring to FIGS. 3A and 3B, an apparatus 30 coupled to an appliance 35 is shown, in accordance with another exemplary embodiment of the present disclosure. The appliance 35 may include any household appliance such as a dishwasher, micro oven, refrigerator and so on. The present example is explained considering that the appliance 35 is a refrigerator. Specifically, the appliance 35 comprises a door 37 that opens sideways. The door 37 may be coupled to the appliance 35 for providing accessibility to the storage space for placing edible items.

At times, a user may place heavy items that will destabilize the door 37 of the appliance 35 resulting bending of the door 37 in downward direction. In order to support the door 37 when it is opened, the apparatus 30 is coupled to the door 37 at top. As explained above, the apparatus 30 comprises an elongated structure 31. The elongated structure 31 comprises a support arm 32 provided in a hook-like structure. The elongated structure 31 further comprises a hinge 33 to swing the elongated structure 31. In order to couple the apparatus 30 to the door 37, at first, the support arm 32 is placed on top of the door 37. As can be seen in FIG. 3A, the elongated structure 31 coupled to the door 37 in a first position P1 is shown. Further, the elongated structure 31 in a second position P2 is shown in FIG. 3B.

When the user wishes to use the apparatus 30 to support the door 37, the user may push the apparatus 30 to the first position P1. When the apparatus 30 is in the first position P1, end of the elongated structure 31 is made to come in contact with a surface such as ground. Further, when it is not required to provide support for the door 37, then the user may adjust the apparatus 30 to the second position P2.

Although the present disclosure is explained that the elongated structure comprises the support arm that is used to couple the apparatus to the door, one skilled in the art will appreciate that apparatus may be coupled to the door without the support arm. For example, the apparatus may be coupled to the door using screws at one end of the elongated structure. In another example, the apparatus may be coupled to the door using an adhesive or other known mechanisms such as welding. Furthermore, the apparatus may be removably coupled to the door so that the apparatus is coupled to the door only when necessary.

The apparatus may be made up of suitable material such as wood, plastic or metal as may be desired by the user. The length of the elongated structure may be adjusted using by adding or removing auxiliary parts, or using other known mechanism. It is to be understood that the apparatus explained above can be used for various appliances used in households. The apparatus is provided to stabilize/support/secure the door of the appliance when the door is in open position. As a result, life of the door can be extended.

The user may operate the apparatus from the first position to the second position or vice versa using hand or leg. Optionally, the apparatus may be made to swing open whenever the door is opened downwards such that the one end of the apparatus come sin contacts with the ground and supports the door.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. An apparatus for supporting a door of an appliance, the apparatus comprising:

an elongated structure;

a support arm coupled to the elongated structure, wherein the support arm is used to couple the elongated structure to the door of the appliance, wherein the door of the appliance is substantially parallel to the ground when opened; and a hinge provided at the elongated structure, wherein the hinge facilitates in rotation of the elongated structure from a first position to a second position, wherein the elongated structure is positioned in the second position such that the elongated structure is made to come in contact with ground to provide support to the door when the door is opened.

2. The apparatus of claim 1, wherein the support arm is provided in a hook-shaped structure to couple to the door.

3. The apparatus of claim 1, wherein length of the elongated structure is adjustable.

4. The apparatus of claim 1, wherein the elongated structure comprises telescopic buttons to adjust the length of the elongated structure.

5. The apparatus of claim 1, wherein the support arm is coupled to the door at the top of the door.

6. The apparatus of claim 1, wherein weight of the door is transferred to the elongated structure when the elongated structure is made to come in contact with ground.

* * * * *